United States Patent [19]

Feldmann et al.

[11] Patent Number: 4,653,304

[45] Date of Patent: Mar. 31, 1987

[54] ROLLING STAND

[75] Inventors: Hugo Feldmann, Alsdorf-Warden; Alexandr Svagr, Hilden; Hans-Heinrich Hartmann, Meerbusch, all of Fed. Rep. of Germany

[73] Assignee: SMS Schloemann-Siemag AG, Düsseldorf, Fed. Rep. of Germany

[21] Appl. No.: 728,596

[22] Filed: Apr. 29, 1985

[30] Foreign Application Priority Data

Apr. 28, 1984 [DE] Fed. Rep. of Germany ..... 3415896

[51] Int. Cl.[4] ..... B21B 31/10

[52] U.S. Cl. ..... 72/239

[58] Field of Search ..... 72/238, 239, 237, 249

[56] References Cited

U.S. PATENT DOCUMENTS 3,491,571 1/1970 O'Brien ..... 72/237 X 4,182,149 1/1980 Wilson ..... 72/249 X 4,368,633 1/1983 Nogota ..... 72/239

*Primary Examiner*—Robert L. Spruill

*Assistant Examiner*—Steve Katz

*Attorney, Agent, or Firm*—Toren, McGeady and Goldberg

[57] ABSTRACT

A rolling stand comprising supporting shaft pairs 3, 4, in which these supporting shafts are supported at two sides and so as to be adjustable in two parallel roll housings 1, 2. At one side, rolling rings 15 can be slipped on the supporting shaft pairs 3, 4, while the other side can be coupled with drive elements 16. The roll housing 2 remote of these drive elements 16 can be moved away from the other roll housing 1 in the direction of the roll axes together with the bearings which are pulled off the supporting shaft pair 3, 4. The supporting shaft pair 3, 4 can be secured and fixed in the other roll housing 1 in the resulting cantilevering position which is supported on one side.

13 Claims, 5 Drawing Figures

ROLLING STAND

Figure 2:
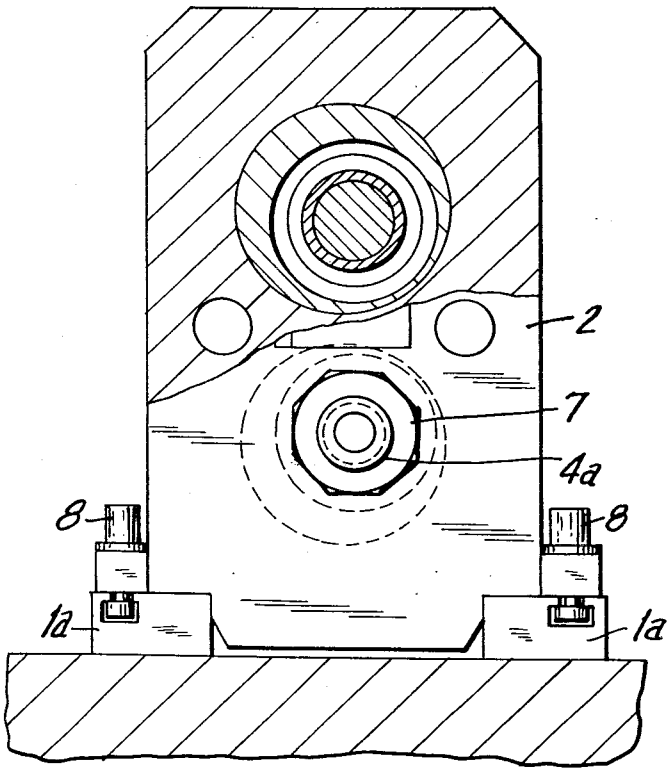

The invention is directed to a rolling stand comprising a pair of supporting shafts for rolling rings which can be slipped on the latter in a receptacle between the two roll housings, the pair of supporting shafts being adjustably supported at two sides in two parallel roll housings and able to be coupled at one side with drive elements.

Rolling stands of this type are used chiefly where the actual roll body must consist of particularly high-grade work materials because the rolling process proceeds at high speed, at high temperatures and/or other influences which very highly stress the roll work material, for example, in the final ingots of modern supporting roll trains. The advantage of these rolling stands consists in that only the rolling ring need consist, e.g. of highly wear resistant and heat resistant work material, while the supporting shafts need only be produced from a work material having to withstand the secondary stresses, for example, the bending forces proceeding from the rolling pressure. Since such rolling rings in the final ingot of wire rolling trains have relatively small diameters and a correspondingly low weight, the need to exchange the rolling rings as a result of wear or for an exchange of the box pass does not present difficulties. For the purpose of exchange, the entire rolling stand, which is usually constructed in a trolleylike manner, was, and is, lifted from a corresponding supporting housing, together with the pair of supporting shafts and the built-in adjusting apparatuses, after disengaging the drive coupling elements from the pair of supporting shafts; it is replaced by means of a prepared, complete stand and the stand provided with the rolling rings to be exchanged is brought to an assembly place where the two roll housings are pulled off of the pair of supporting shafts and the rolling rings are slipped down from the latter and replaced by new ones. The rolling stand, which is subsequently put together again in a corresponding manner, is then available for the next exchange.

With respect to rolls of large weight, for example, those used in the roughing trains of wire rolling trains or in trains for billets or other section steels, for the purpose of exchanging rolls one previously either exchanged a complete stand for the other, or only the respective sets of rolls with their bearing chocks, usually held together by a box, were constructed in such a way that they could be driven out of the stand and exchanged. However, solid material rolls without rolling rings which could be slipped on were always used.

It has also already been suggested for rolling train portions in which the rolling forces are substantially greater than in the final ingots of wire rolling trains, to use supporting shafts with slip-on rolling rings, specifically in such a way that a rolling stand comprising a pair of adjustable roll supporting shafts supported at two sides, on which the rolling rings can be exchangeably slipped on at one side (cantilevering), and were for this reason exchangeable in themselves without the supporting shafts and stand parts belonging to the latter, was reinforced, after slipping on the rolling rings, by means of a pair of neck bearings which was slipped onto neck projections of the supporting shafts, which neck projections cantilevered over the rolling rings. The bearing housings were connected with one another in a force-locking or form-locking manner, respectively, in order to receive the rolling forces.

Proceeding from the suggestion last mentioned, the invention has the object of improving the rolling stand of the aforementioned type in such a way that roll supporting shafts with rolling rings are usable also with larger stand dimensionings, such as those required for billet trains, section steel trains or other roll trains, and the rolling rings can be exchanged without requiring a displacement or disassembly of the entire rolling stand.

This object is met in that the roll housing remote of the drive elements of the supporting rolls, along with the bearings pulled off the supporting shaft pair, is moved away from the other roll housing in an axial direction relative to the rolls in a manner, known per se, and the pair of supporting shafts is securable and fixable in the resulting cantilevering position, which is supported at one side, in the other roll housing.

With this solution, it is achieved that, when exchanging only the rolling rings, the substantial part of the rolling stand, particularly the pair of supporting shafts, remains in its position relative to the rolling line, i.e. also in the respective adjusting position, and the coupling of the supporting shafts with the drive elements likewise need not be disengaged.

As provided, in addition, by the invention, adjustable and fixable support surfaces for contact surfaces of the portions of the supporting shafts located between the bearing of this roll housing and the drive elements of the supporting shafts, which contact surfaces can be laid on these support surfaces, can be arranged in the roll housing that is not moved, the support surfaces facilitating the holding and fixing of these portions of the supporting shaft. Holding elements, which are connectable and disengageable with the rolling rings and consist, for example, of a bushing which is connected with the inner ring of the bearing and can be slipped on the supporting shaft, can be arranged at the movable roll housing, the rolling ring being able to be slipped on the outer circumference of the bushing. The bushing can be constructed, in a manner known per se, as a divided, slotted or undivided neck bushing with a conically extending inner circumferential surface and cylindrical outer circumferential surface. The neck bushing can also have an annular step forming the inner ring of the bearing. In rolling stands with eccentric bushings as adjusting elements, the eccentric bushings being rotatably supported in the roll housings and enclosing the bearings, these eccentric bushings can pass into a cylindrical elongation enclosing the supporting shaft, whose ring end, which faces the drive elements of the supporting shafts, forms an axially inwardly directed collar which forms an annular support surface for the supporting shaft portion to be laid on. The adjusting apparatuses of the two roll housings are advisably coupled with one another. The rolling fittings common to the two roll housings can be supported by the movable roll housing and can be fastened at the latter, as well as connected in a plug type connection with the other roll housing.

In addition, the invention provides a supporting carriage for the movable roll housing which has a pair of supporting bolts which can be driven into the shaft openings of the two bearings of the roll housing, the supporting bolts being positionable and fixable on the supporting carriage by means of an adjusting apparatus corresponding to the adjusting apparatus of the roll housing. A rotating disk for receiving the supporting carriage can be arranged on the operating side in front of the rolling stand in a manner known, per se. A plurality of these rotating disks can also be arranged on a rotary cross, as additionally provided by the invention, wherein the spacing of the rotating points of the consecutive rotating disks on the rotary cross is dimensioned in such a way that they can be brought, in each instance, into the elongations of the axial line of consecutive rolling stands of a roll train, e.g. in such a way that the rotating points of half the rotating disks arranged on the rotary cross, in each instance, can be aligned, at the same time, with the corresponding quantity of successive rolling stands. The supporting carriages can have their own drive units.

The invention will be explained in more detail with the aid of the embodiment examples shown in the drawing. The drawing shows FIG. 1 the rolling stand seen from the side, partly in axial section, FIG. 2 the front view of FIG. 1, partly in section, FIG. 3 the rolling stand according to FIG. 1 in disassembled state, FIG. 4 an additional arrangement seen from the side, partly in section, and FIG. 5 the top view of FIG. 4.

Figure 1:
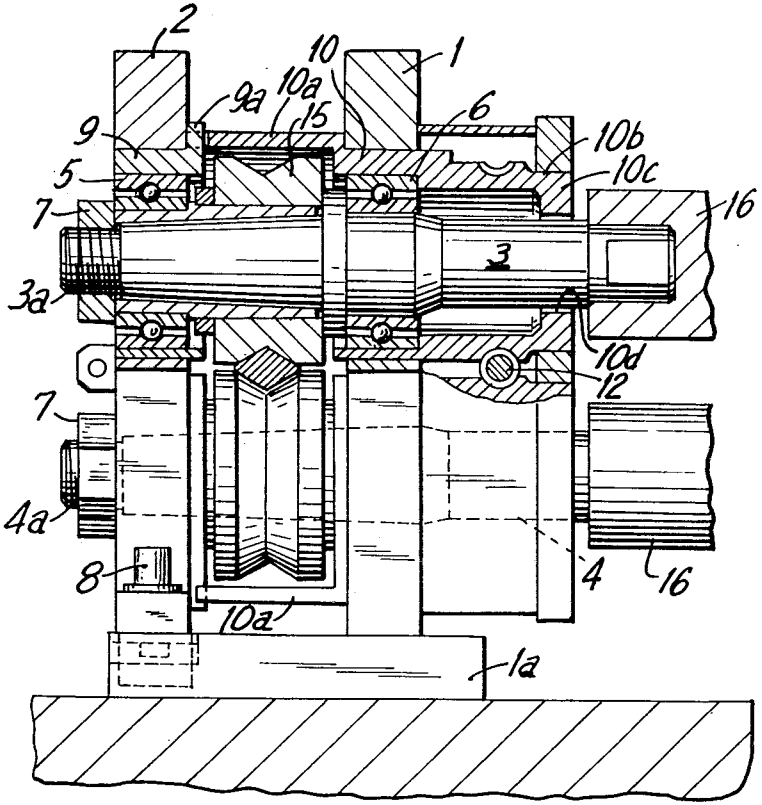

As can be seen from FIG. 1, the rolling stand consists of the roll housing 1 which is connected in a stationary manner with a base 1*a*, in a manner not shown, with the floor and of the roll housing 2 which is screwed on the base 1*a* by means of a screw connection 8. Supporting shafts 3 and 4 of the supporting shaft pair are supported in bearings 5 and 6, respectively, in the two roll housings 1 and 2; at the end facing the roll housing 2, they have a threaded portion 3*a* and 4*a*, respectively, on which a nut 7 is screwed in each instance.

In the embodiment example, the bearings 5 and 6 are each located in eccentric bushings 9 and 10, which are, in turn, rotatably supported in the roll housings 1 and 2 and form the adjusting apparatus for the supporting shafts 3, 4. The eccentric bushing 10 in the roll housing 1 cantilevers with a ring segment portion 10*a* over the respective rolling ring 15 and is connected in a plug type connection with a corresponding ring projection 9*a* of the other eccentric bushings with the effect that when the eccentric bushings 10 are rotated by means of a threaded spindle 12 in the roll housing 1, this rotation is transmitted to the eccentric bushing 9. The eccentric bushing 10 arranged in the roll housing 1 passes into a cylindrical elongation 10*b*, which encloses the supporting shaft 3, 4,whose ring end facing the drive coupling 16 has an inwardly directed collar 10*c* which forms a cylindrical support surface 10*d* for the portion of the supporting shaft 3, 4 between the bearing 6 and the drive coupling 16.

Figure 3:
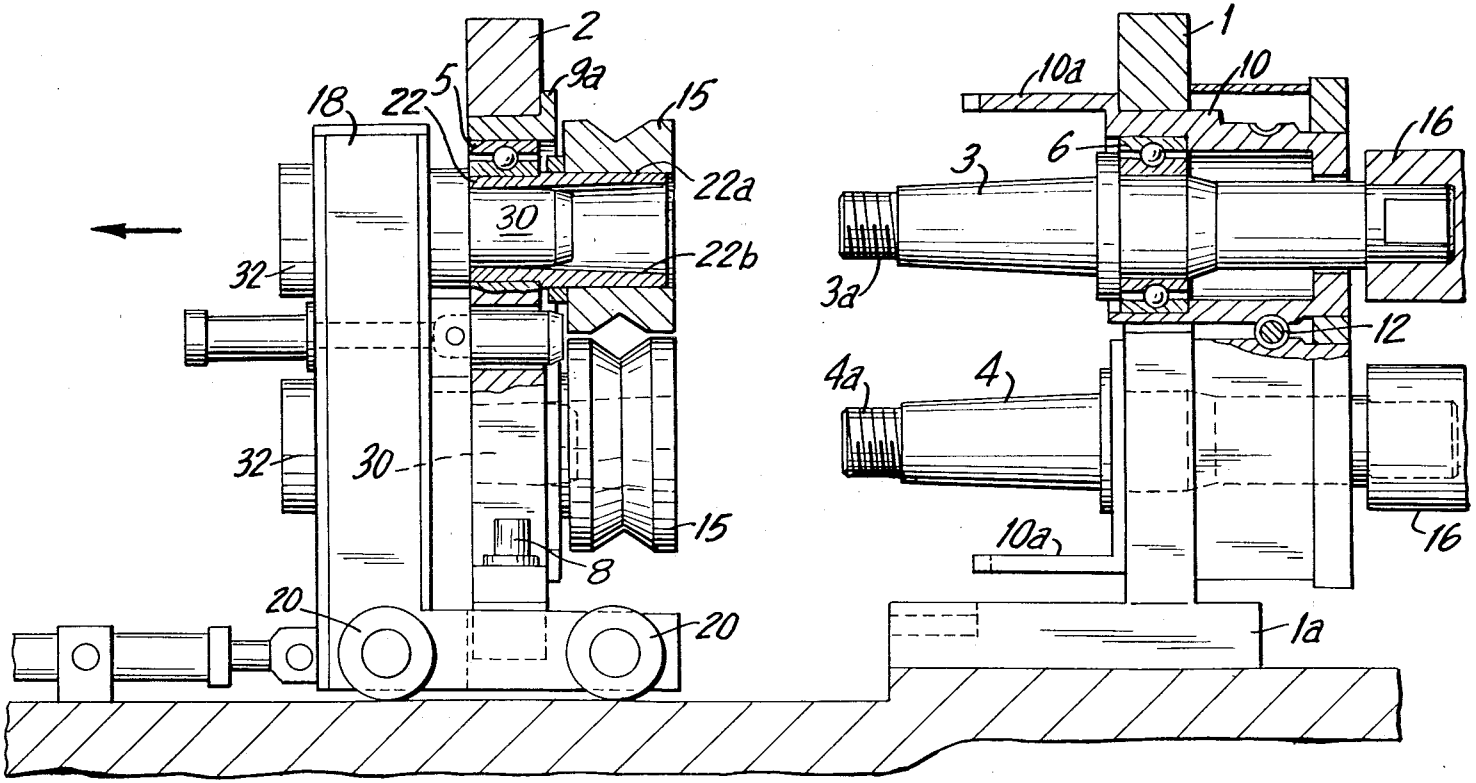

After loosening the screw connection 8, the roll housing 2 of the rolling stand 1, 2 is moved away from the roll housing 1 in the direction of the drawn-in arrow with the aid of the supporting carriage 18 which is drivable on rollers 20, shown in FIG. 3, and the bearing 5 is accordingly pulled off of the supporting shafts 3, 4. In the embodiment example, the rolling rings 15 sit on the cylindrical outer surface 22*a* of bushings 22 with conically extending inner surface 22*b*. These bushings 22 simultaneously form the bearing inner ring of the bearing 5. The rolling rings 15 in this construction are therefore brought out of the rolling stand together with the roll housing 2 and held in their pulling out positions. Supporting bolts 30, which enter into the bearing openings of the bearing 5 during the pulling out movement of the carriage 18 which frees these bearing openings, serve as holding elements. These supporting bolts 30 can be aligned with the respective adjusting position of the bearing 5 or of the bushing 22, respectively, with the aid of the adjusting apparatuses arranged on the supporting carriage 18.

Figure 4:
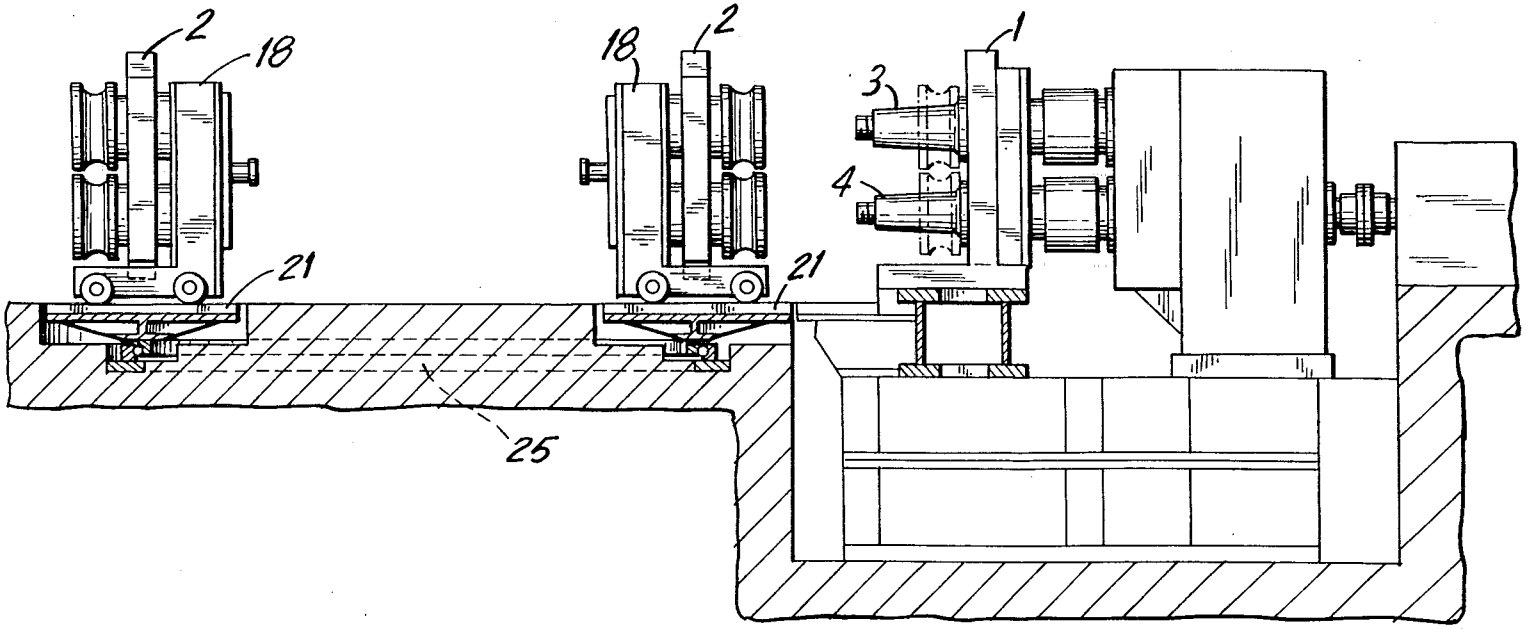
Figure 5:
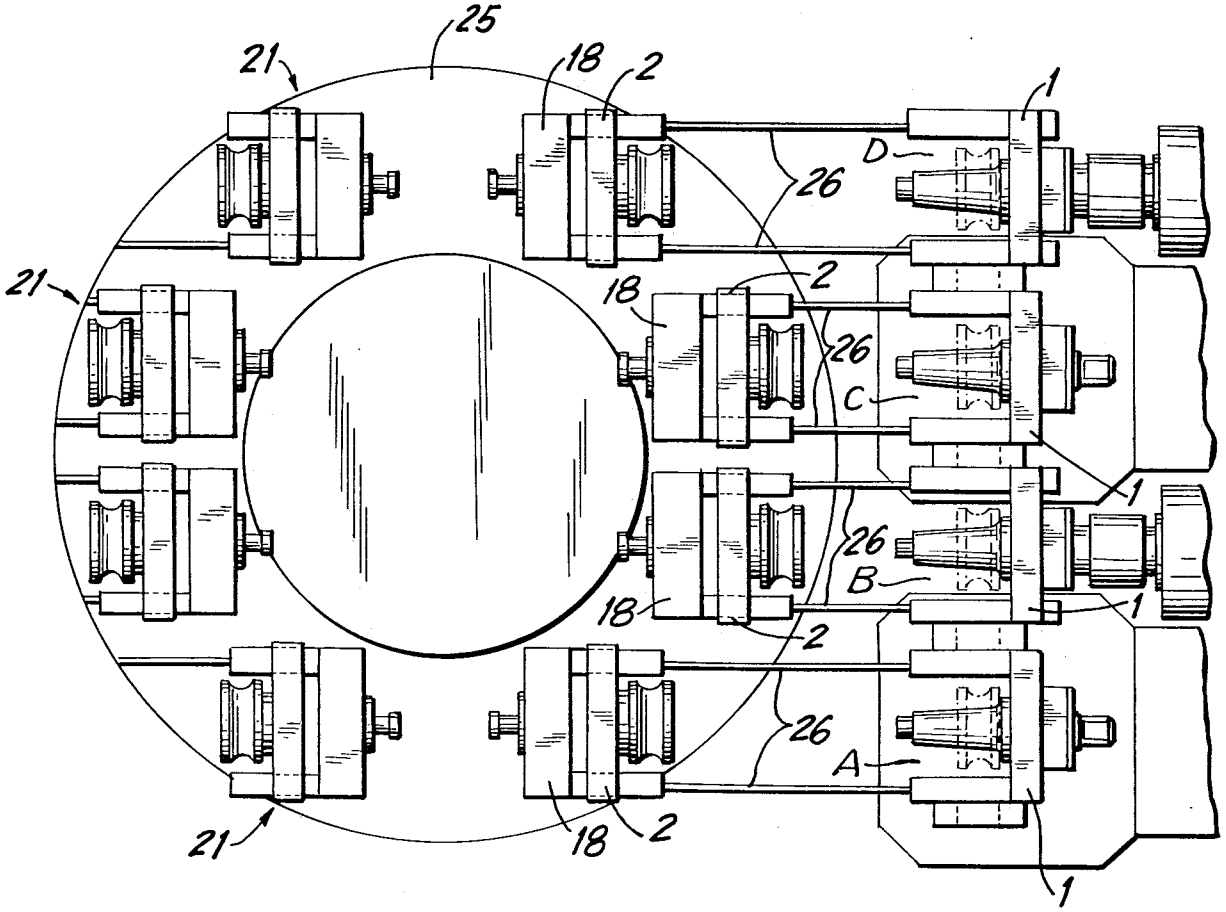

As seen from FIGS. 4 and 5, after the supporting carriages 18 have pulled the respective roll housing 2 from the consecutive rolling stands of a roll train via rail pairs 26, which rolling stands are designated by A, B, C and D (compare FIG. 5), the supporting carriages 18 can be applied to the rotating disks 21 of a rotary cross 25, specifically, as shown in the embodiment example, four supporting carriages 18, in each instance, simultaneously or consecutively, if the spacing of the rotating points of consecutive rotating disks 21 on the rotary cross 25 is dimensioned in such a way that these rotating points are accommodated in the elongations of the axial lines of consecutive rolling stands A, B, C, D of the roll trains. In the embodiment example, half of the rotating disks 21 arranged on the rotary cross 25 are, in each instance, alignable with the four consecutive rolling stands A, B, C, D.

With the aid of a drive unit, not shown, the supporting carriages 18 can be automatically driven up to the rotating disks 21 and can be driven away from the latter again via the rail pairs 26.

What is claimed is:

1. Rolling stand and support structure comprising a pair of roll housings disposed in spaced relation, a pair of supporting shafts extending between and supported by said roll housings, said supporting shafts each forming a roll axis with the roll axes extending through said roll housings, a rolling ring for each said support shaft, said rings being removably mounted on said supporting shafts, said supporting shafts each having a pair of opposite ends and the opposite ends thereof being adjustably supported in said roll housings, drive elements connected to one end of each said supporting shaft in one of said roll housings, bearings in each of said roll housings for said supporting shafts, wherein the improvement comprises that the one said housing being secured in a stationary position, said supporting shafts being fixed in the axial direction thereof within the one said roll housing, said bearings in the one said roll housing being spaced in the direction of said roll axes from said drive elements, said supporting shafts are supported directly in said roll housing, means for movably displacing the other said roll housing remote from said drive elements and said bearings therein as a unit in the roll axis direction between a first position supporting said supporting shafts and a second position displaced out of supporting engagement with said supporting shafts, means extending in the roll axes direction between said roll housings and laterally enclosing said rolling rings and including support surfaces located in the axial direction of said roll axes between said bearings in the one said housing and said drive elements with said support surfaces being placeable in contacting engagement with a portion of said supporting shafts located therebetween with said surfaces being arranged on and supported by the one of said roll housings, and means located in the other said roll housing for mounting said rolling rings on the other said roll housing.

2. Rolling stand and support structure, as set forth in claim 1, wherein said means for mounting said rolling rings to the other said roll housing comprises a bushing for each of said supporting shafts located within said bearings in the other said roll housing, each said bushing being slippable on one of said supporting shafts and one of said rolling rings being slippable on to the outer circumference of each of said bushings.

3. Rolling stand and support structure, as set forth in claim 2, wherein said bushings are formed as neck bushings with a conically shaped axially extending inner circumferential surface and a cylindrically shaped axially extending outer circumferential surface.

4. Rolling stand and support structure, as set forth in claim 3, wherein each said neck bushing has an annular projection forming the inner support of said bearings in the other said roll housing.

5. Rolling stand and support structure, as set forth in claim 1, wherein said means extending between said roll housings and said means in the other said roll housing for mounting said rolling rings include eccentric bushings rotatably supported in said roll housings and enclosing said bearings therein, said eccentric bushing in the one of said roll housings including a cylindrical elongation extending from the one said housing toward the other said housing and laterally enclosing said supporting shafts and said eccentric bushings include an inwardly directed collar forming a cylindrical support surface on the one side of the one said roll housing remote from the other said roll housing and arranged to support said supporting shafts.

6. Rolling stand and support structure, as set forth in claim 1, wherein said means located between said roll housings and said means mounting said rolling ring to the other said roll housing being detachably connected to one another.

7. Rolling stand and support structure, as set forth in claim 6, wherein said means located between said roll housing and said means mounting said rolling rings to the other said roll housing are detachably connected in a plug type connection.

8. Rolling stand and support structure, as set forth in claim 1 including a supporting carriage movably supporting the other said roll housing for movement between the first and second positions, said supporting carriage having a pair of supporting bolts thereon engageable into the openings of said bearings in the other said roll housing when the other said roll housing is displaced into the second position out of supporting engagement with said supporting shafts, and an adjusting apparatus connected to said supporting bolts for positioning said supporting bolts in said bearings in the other said roll housing.

9. Rolling stand and support structure, as set forth in claim 8, including a horizontal rotating disc spaced on the opposite side of the other said roll housing from the one said roll housing and arranged to receive and support the other said roll housing when it is displaced outwardly into the second position from supporting contact with said supporting shafts.

10. Rolling stand and support structure, as set forth in claim 9, including a rotary cross arranged to support a plurality of said rotating discs with each said rotating disc arranged to receive one other said roll housing when the other said roll housing is displaced into the second position out of supporting engagement with said supporting shafts.

11. Rolling stand and support structure as set forth in claim 10, wherein a plurality of said roll housings are spaced apart laterally relative to the axes of said supporting shafts and said rotating discs on said rotary cross are positioned in the same relationship as the plurality of said roll housings so that said rotating discs are located in general alignment with the axial direction of said supporting shafts in each of said roll housings.

12. Rolling stand and support structure, as set forth in claim 11, wherein said rotary cross being arranged to align one of said rotary discs with one of said pair of roll housings.

13. Rolling stand and support structure, as set forth in claim 8, wherein a separate drive unit is provided for said supporting carriage.

* * * * *